United States Patent [19]

Duggins

[11] 4,219,061

[45] Aug. 26, 1980

[54] MITER CHOPPER ATTACHMENT FOR MEASURING PICTURE FRAME MOLDING

[75] Inventor: Richard W. Duggins, Cedar Grove, N.C.

[73] Assignee: S. & W. Framing Supplies, Inc., New Hyde Park, N.Y.

[21] Appl. No.: 957,214

[22] Filed: Nov. 2, 1978

[51] Int. Cl.[2] ..... B27G 5/04

[52] U.S. Cl. ..... 144/217; 33/180 R; 33/185 R; 83/435.1; 83/522

[58] Field of Search ..... 269/307, 303; 33/180 R, 33/185 R; 144/217; 83/435.1, 471.3, 522, 761, 765

[56] References Cited

U.S. PATENT DOCUMENTS

| | | | |
|---|---|---|---|
| 2,998,813 | 9/1961 | Wilson | 83/435.1 |
| 3,854,360 | 12/1974 | Reed | 83/522 |
| 4,111,088 | 9/1978 | Ziegelmeyer | 83/522 |
| 4,122,739 | 10/1978 | Marlow | 83/435.1 |

*Primary Examiner*—W. Donald Bray
*Attorney, Agent, or Firm*—B. B. Olive

[57] ABSTRACT

A measuring attachment for a standard miter chopper used in mitering rabbeted picture frame molding employs two arm members one of which can be adjusted in reference to a fixed scale on the front rail for measuring off a desired length of rabbeted molding and the other of which can be located so as to bring the leading inside edge of a previously mitered molding rabbet to an appropriate temporarily fixed position corresponding to the desired length to be chopped.

7 Claims, 9 Drawing Figures

FIG. 1
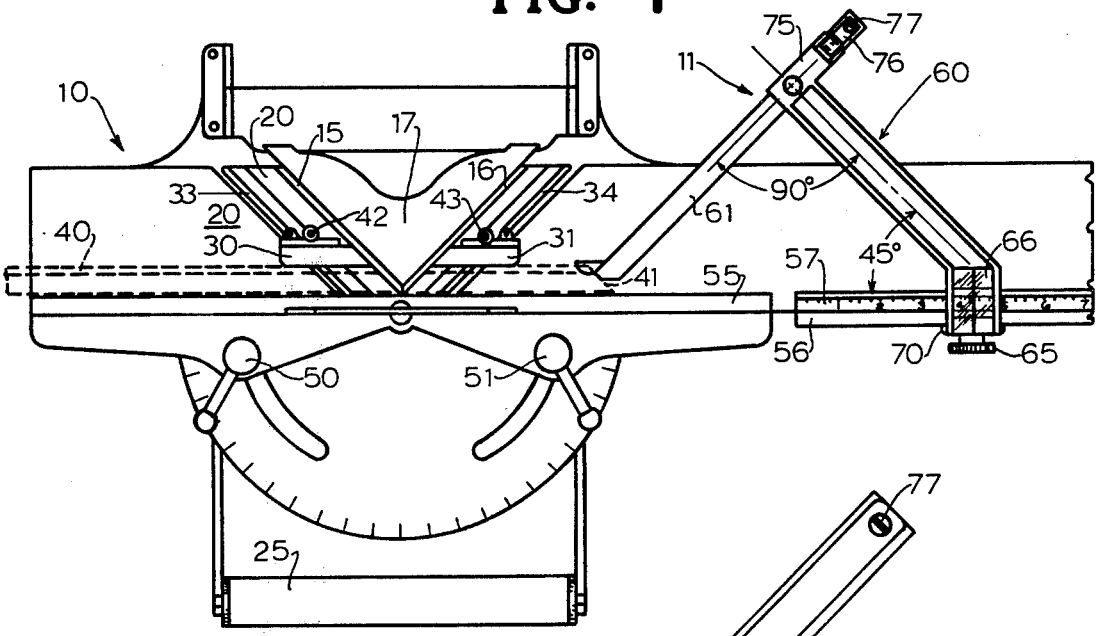
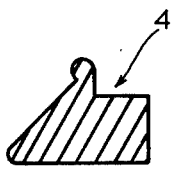
FIG. 9
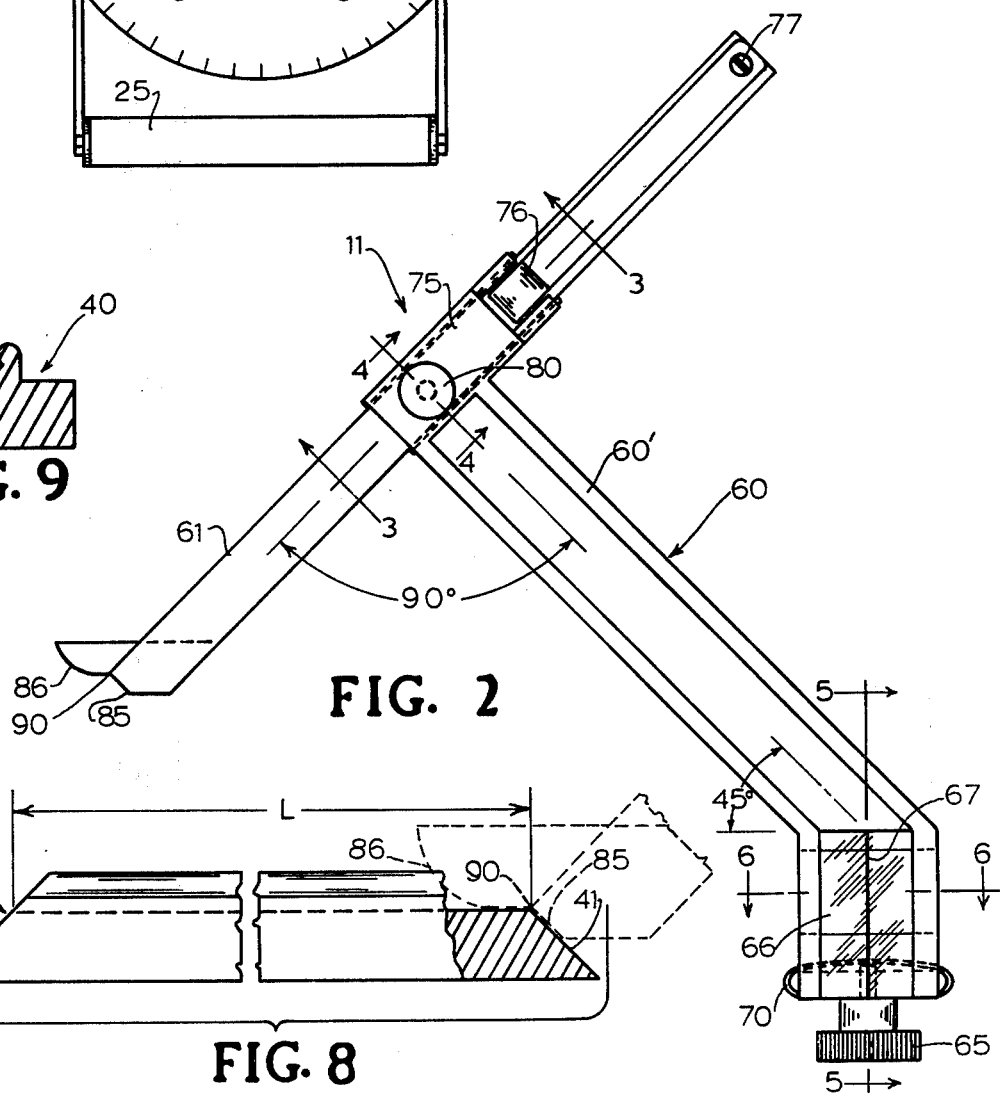
FIG. 2
FIG. 8

MITER CHOPPER ATTACHMENT FOR MEASURING PICTURE FRAME MOLDING

BACKGROUND OF THE INVENTION

1. Field of the Invention

The invention relates to apparatus for chopping picture frame molding and more specifically to a measuring attachment for a standard miter chopper.

2. Description of the Prior Art

Miter choppers employed for chopping picture frame molding have essentially become standardized in their construction. The standard miter chopper employs two blades mounted at some predetermined included angle, e.g., 90°. In use, it is necessary to measure off the length of molding to be cut and then a foot operated pedal linkage is used to bring both of the blades through the molding at the desired location to effect trailing and leading cuts. So far as is known, there are only two types of apparatus utilized for measuring off the length of molding to be cut. In one form of prior art measuring apparatus used on a standard miter chopper, a scale is scribed on the bed of the chopper at a 45° angle to the front of the bed. The molding length is determined by aligning the point at which the inside of the rabbet and the mitered end of the molding intersect with the appropriate mark on the chopper bed scale, then sliding a movable stop along the front rail of the chopper until it abuts the end of the molding. While this is the most common method of determining molding length, difficulties of accurate measurement are frequently encountered in attempting to read a scale at a 45° angle to the operator, graduated in one-eighth inch increments, and covering the full width, normally five and one-half inches, of the chopper bed.

In another type of measuring apparatus used on the standard miter chopper, a vernier arrangement composed of three scales is employed. The first of these scales is a molding width scale located near the chopper head and perpendicular to the front rail of the chopper bed. The first scale is used for determining molding width as measured from the back of the molding to the inside of the rabbet. The second scale is a standard inch scale affixed to the front rail of the chopper. The third scale is a vernier scale mounted on the movable stop. Thus, molding length is determined by first determining the molding width with the first scale, then lining up the corresponding mark on the third vernier scale with the desired molding length on the second inch scale mounted on the front rail. While this second form of prior art apparatus is more easily read than the first mentioned prior art measuring apparatus, users frequently encounter misreadings by virtue of the three scales involved.

Thus, it becomes the general object of the present invention to improve upon those prior art miter chopper measuring devices described above and particularly to simplify and make more accurate the measuring operation.

SUMMARY OF THE INVENTION

The measuring attachment of the invention is designed to be slidably mounted on the front rail of a standard miter chopper on which a reference measuring scale is mounted. The measuring attachment of the invention involves one arm, referred to as the mounting arm and which is slidably mounted on the front rail in reference to the measuring scale. The mounting arm provides an outwardly extending cantilever arm on which a second arm, referred to as the positioning arm, is slidably mounted with a spring-loading arrangement.

In use, the mounting arm is appropriately positioned and fixed in reference to the scale at a position corresponding to the desired length of molding to be cut. Then, the engaging arm is brought into engagement with the leading inside edge of the previously mitered molding rabbet and is temporarily fixed in that position with the molding otherwise supported by the conventional supports. The conventional foot pedal linkage is then used to draw both of the blades through the molding to effect the cuts, one being a leading and the other a trailing cut.

DESCRIPTION OF THE DRAWINGS

FIG. 1 is a plan view of a standard miter chopper with a measuring attachment according to the invention and with the molding to be cut shown in dashed lines.

FIG. 2 is an enlarged plan view of the measuring attachment of the invention.

FIG. 8 is a fragmentary plan view of a strip of molding material of the type measured by the measuring attachment of the invention.

FIG. 9 is a section view through the molding strip shown in FIG. 8.

DESCRIPTION OF THE PREFERRED EMBODIMENT

Figure 3:
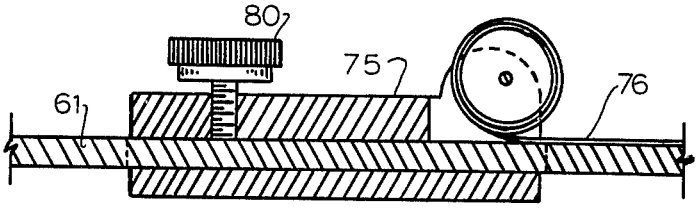
FIG. 3 is a section view taken on line 3—3 of FIG. 2.
Figure 4:
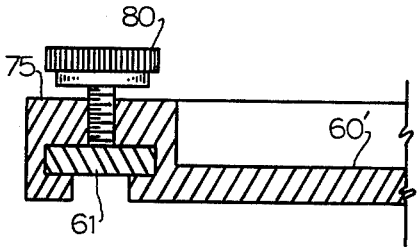
FIG. 4 is a section view taken on line 4—4 of FIG. 2.
Figure 5:
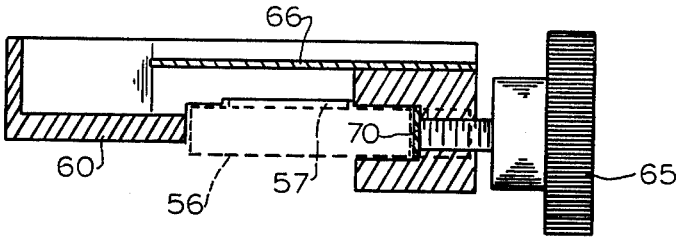
FIG. 5 is a section view taken on line 5—5 of FIG. 2.
Figure 6:
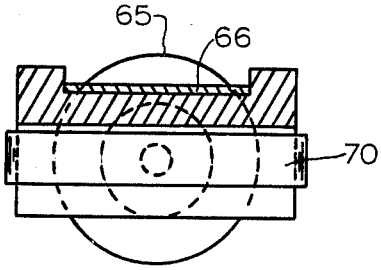
FIG. 6 is a section view taken on line 6—6 of FIG. 2.

The measuring attachment of the invention is adapted for mounting on a standard miter chopper such as manufactured and sold under the Morsø and Jyden brands. Since the construction employed in the standard miter chopper is generally well known and understood by those who practice the art of making picture frames, only a limited description of the standard miter chopper 10 will be given.

As best seen in FIG. 1, the chopper knives 15, 16 attach to a knife support member 17 and move up and down against the chopping bed 20 to effect cutting by means of the foot pedal arrangement 25. A pair of adjustable supports 30, 31 operate in guideways 33, 34 and are secured against the molding 40, indicated in dashed lines in FIG. 1, by means of tightening knobs 42, 43. While not pertinent to the present description, it will also be observed that provision is made for swinging the fence structure by means of the additional adjusting knobs 50, 51.

The standard miter chopper of the type to which the present invention attachment is adapted includes a base guide rail 55 against which the molding 40 is clamped during chopping and an additional rail member referred to as a front rail 56. For purposes of the present invention a suitable scale 57 is secured to front rail 56 on which the desired length of molding to be cut is measured as later described.

Figure 7:
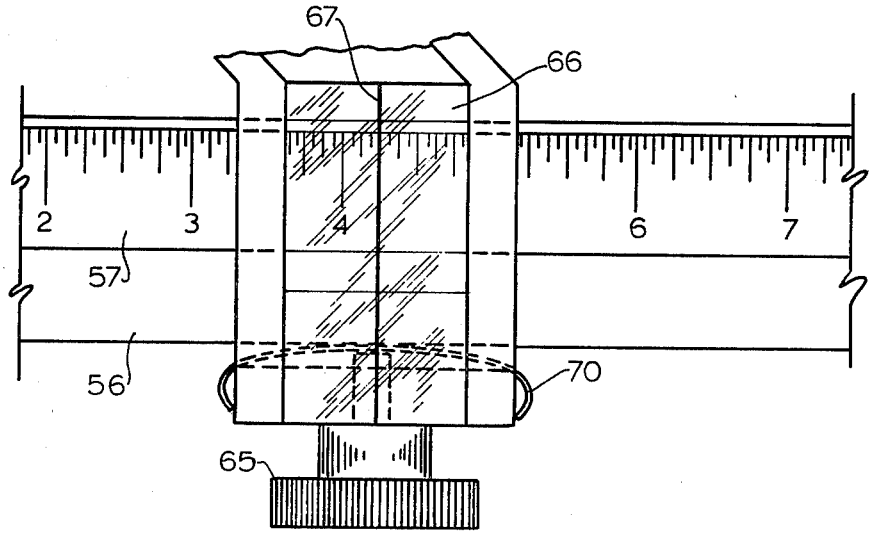
FIG. 7 is an enlarged fragmentary plan view of the indexing portion of the measuring attachment of the invention.

The apparatus of the invention basically employs two interconnected arm members one of which is designated as the mounting arm 60 and the other of which is designated as the holding arm 61, the interconnected arm assembly being designated 11. As best illustrated by FIGS. 1 and FIGS 5–7, the mounting arm 60 provides a slot arrangement enabling mounting arm 60 to slidably engage the front rail 56 and to be temporarily secured thereto by means of a clamping knob 65. A lens member 66 has an index line 67 which can be brought in alignment with a desired scale indication. As best illustrated in FIG. 7 showing a setting of four and one-fourth inches, the position of index line 67 with reference to scale 57 indicates the length of molding to be cut. A leaf spring 70 assists in maintaining the appropriate alignment of index line 67 with reference to scale 57. The longitudinal axis of the outwardly extending arm portion 60' of mounting arm 60 resides at a 45° angle with respect to the longitudinal axis of front rail 56 and at a 90° angle with respect to the longitudinal axis of the holding arm 61 as depicted in FIGS. 1 and 2.

Holding arm 61 resides and slides in a slotted portion 75 of mounting arm 60 and moves back and forth against the tension of a coiled, constant force, ribbon spring 76 mounted on the slotted end portion 75 of mounting arm 60 and having a secured end held by screw 77. Holding arm 61 can be positioned against the tension of spring 76 and held in a selected position by means of a fastening knob 80.

The lower end of holding arm 61 is formed with a flat serrated face portion angled at 45° to coincide with the angle of cut and a curved face portion 86 adjacent thereto, i.e., adjacent face portion 85.

In use, it will be noted that the holding arm 61 maintains a 45° relation to the longitudinal axis of front rail 56. When a new piece of molding is to be cut, the mounting arm 60 is moved along the front rail 56 of the chopper until the index mark 67 on mounting arm 60 aligns with the scale indication corresponding to the desired length of molding to be cut. Mounting arm 60 is then locked in position by means of the locking knob 65. The molding, whose leading end 41 will have already been mitered is then moved along the chopper bed 20 in such a way as to cause the flat curved surface 86 and flat surface 85 to ride up the leading mitered end 41 of the molding until the line of intersection of flat surface 85 and curved surface 86, indicated at 90 slides under the rabbet of the molding and assumes the position indicated in FIG. 8. At this point the mitered leading end 41 of the molding 40 is abutting the serrated surface 85 on the end of holding arm 61 thus restricting any further forward movement of the molding. Thus, the point at which the inside edge of the molding rabbet intersects the leading mitered end 41 of the molding has been effectively located allowing its use in conjunction with the appropriately located scale measure for determining the length L of the molding to be cut as measured inside the rabbet of the molding. At this stage, supports 30, 31 will also be temporarily securely clamped against molding 40 by means of their respective clamping knobs 42, 43 as depicted in FIG. 1 after which the trailing end cut will be taken by knife 16 as depicted in FIG. 1 by operating the pedal linkage 25. Simultaneously, when two knives are being employed, e.g. knives 15, 16, as shown in FIG. 1, the leading end for the next succeeding piece of molding may also be cut by blade 15.

While illustrated as being adapted to measurement of a miter of 45°, it should be noted that simply by changing the angle of the holding arm 61 with respect to the front rail 56 of the chopper either in a fixed relation or by making such angle adjustable, the measurement attachment of the invention might easily be adapted to measurement of miters other than 45° as illustrated.

It may also be noted that the measuring attachment of the invention is generally applicable to other types of cutoff devices provided with a rail for mounting the measuring attachment of the invention and having other means, e.g., a saw, for cutting and means for supporting and holding the molding other than that shown. Also, the material of which the molding is formed may be other than natural wood, e.g., plastic, and of different cross-sectional shape from that illustrated.

In summary, the measuring attachment of the invention thus provides a simple, extremely easy and quick method for measuring the length of molding to be cut, precisely and accurately positioning the molding prior to chopping or otherwise cutting the strip and for providing a means for securing the molding in position during cutting so as to result in precise and accurate cuts on each occasion of use of the attachment.

What is claimed is:

1. In a miter chopper used in mitering rabbeted picture frame molding and of the type having a knife support member, at least one chopper knife, a base guide rail, a front rail, a chopping bed and foot pedal operating means, a measuring attachment comprising:

(a) a scale fixed on the top surface of said front rail and providing measuring indicia capable of determining the length of the rabbeted molding strip to be mitered;

(b) a pair of interconnecting arm members, said arm members comprising:

(i) an elongated mounting arm having a base portion slidably mounted on said front rail, and having means for locking said arm base portion on said front rail at selected positions thereon corresponding to selected lengths of rabbeted molding to be mitered, said mounting arm further having a lens member on said base portion providing means for viewing said measuring indicia on said scale therethrough, an arm portion extending outwardly from said base portion, the longitudinal axis of said arm portion residing at a fixed selected angle with respect to the longitudinal axis of said front rail corresponding to the angle of miter being cut; and (ii) an elongated holding arm adjustably and slidably mounted in a slotted outer end portion of the outwardly extending arm portion of said mounting arm with the longitudinal axis of said holding arm held at a fixed angular relation to the longitudinal axis of the outwardly extending arm portion of said mounting arm, means on a lower end portion of said holding arm for mating in flush relation with the leading mitered end of a rabbeted molding strip to be cut to a desired length and for restricting the forward movement of said rabbeted molding strip as it rests against said base guide rail, additional means on said lower end portion of said holding arm for mating with the leading inside edge of the rabbet of said molding strip and means for retaining said holding arm fixed in position on said mounting arm portion in a respective holding position corresponding to the length of rabbeted molding being cut.

2. In a miter chopper as claimed in claim 1 including retracting means mounted on said arm portion and connected to said holding arm to return said holding arm to a predetermined position within said arm portion.

3. In a miter chopper as claimed in claim 2 wherein said retracting means comprises a coiled constant force ribbon spring mounted on said arm portion and having a free end secured to an upper end of said holding arm.

4. In a miter chopper as described in claim 1 wherein the included angle between longitudinal axis of said mounting arm portion and the longitudinal axis of said rail is forty-five degrees and the included angle between the longitudinal axis of said mounting arm portion and the longitudinal axis of said holding arm is ninety degrees.

5. In a miter cutter for cutting rabbeted picture frame molding strip and the like of the type having a frame mounting a cutting device, a bed and fence and operating means for operating the cutting device to miter a trailing end of the strip, a measuring apparatus, comprising:

(a) an auxiliary rail member positioned on said frame adjacent said fence;

(b) a scale fixed on the top surface of said rail member and providing measuring indicia capable of determining the length of the strip to be mitered;

(c) a pair of interconnecting arm members, said arm members comprising:

(i) an elongated mounting arm slidably mounted on said rail member, said mounting arm having means for locking said arm on said rail member at selected positions thereon corresponding to selected lengths of strip to be mitered, said mounting arm also having a hairline and means mounting said hairline for viewing said measuring indicia on said scale in reference thereto, and having an arm portion extending outwardly from said rail member, the longitudinal axis of said arm portion residing at a fixed selected angle with respect to the longitudinal axis of said rail member corresponding to the angle of miter being cut; and (ii) an elongated holding arm adjustably and slidably mounted on an outer end portion of the outwardly extending arm portion of said mounting arm with the longitudinal axis of said holding arm held at a fixed angular relation to the longitudinal axis of the outwardly extending arm portion of said mounting arm, means on a lower end portion of said holding arm for mating in flush relation with the leading mitered end of a strip to be cut at its trailing end to a desired length and for restricting the forward movement of said strip as it rests against the fence and means for retaining said holding arm fixed in position on said mounting arm in a respective holding position corresponding to the length of strip being cut.

6. In a miter cutter as claimed in claim 5 including retracting means mounted on said arm portion and connected to said holding arm to return said holding arm to a predetermined position within said mounting arm portion whenever released therefrom.

7. In a miter chopper as claimed in claim 6 wherein said retracting means comprises a coiled constant force ribbon spring mounted on said arm portion and having a free end secured to an upper end of said holding arm.

* * * * *